United States Patent [19]

Nicholas et al.

[11] Patent Number: 4,913,947

[45] Date of Patent: Apr. 3, 1990

[54] SEAM FOR PAPERMAKER'S FELT

[75] Inventors: Dimitri P. Nicholas, Savannah, Ga.; Pieter S. Diehl, Pleasant Hill, Ohio

[73] Assignee: The Orr Felt Company, Piqua, Ohio

[21] Appl. No.: 305,269

[22] Filed: Feb. 1, 1989

[51] Int. Cl.[4] ..... B32B 3/00

[52] U.S. Cl. ..... 428/60; 428/61; 428/234

[58] Field of Search ..... 428/60, 61, 58, 234; 162/199

[56] References Cited

U.S. PATENT DOCUMENTS

| | | | |
|---|---|---|---|
| 2,883,734 | 4/1959 | Draper, Jr. | 162/199 |
| 2,893,007 | 7/1959 | Windt | 162/199 |
| 2,907,093 | 10/1959 | Draper, Jr. | 162/199 |
| 3,283,388 | 11/1966 | Kelleher et al. | 162/199 |
| 3,815,645 | 6/1974 | Codorninu | 139/383 A |
| 4,095,622 | 6/1978 | MacBean | 139/383 A |
| 4,123,022 | 10/1978 | Dutt et al. | 245/10 |
| 4,401,137 | 8/1983 | Cannon | 139/383 A |
| 4,435,457 | 3/1984 | Servo et al. | 428/58 |
| 4,539,730 | 9/1985 | Romanski | 24/33 B |
| 4,574,435 | 3/1986 | Luciano et al. | 24/33 C |
| 4,601,785 | 7/1986 | Lilja et al. | 162/199 |
| 4,698,250 | 10/1987 | Talonen et al. | 428/58 |
| 4,737,241 | 4/1988 | Gulya | 162/199 |
| 4,743,482 | 5/1988 | Johansson et al. | 428/57 |
| 4,755,260 | 7/1988 | Sakuma | 162/199 |
| 4,764,417 | 8/1988 | Gulya | 428/222 |
| 4,775,446 | 10/1988 | Eschmann | 162/199 |

FOREIGN PATENT DOCUMENTS 57-55358 2/1982 Japan .

*Primary Examiner*—Alexander S. Thomas

*Attorney, Agent, or Firm*—Biebel, French & Nauman

[57] ABSTRACT

A pin seam type of papermaker's wet press felt is disclosed in which a base fabric, joined by a pin seam, has a relatively heavy batting applied to at least one surface. The batting is cut through at the pin seam to form a joint in the batting, defined by opposed free ends. One of the free ends in the batting is formed with a transverse Vee groove, and the opposed free end is formed with a transverse Vee proportioned to be received in the groove, thereby forming an interlocking joint.

3 Claims, 2 Drawing Sheets

SEAM FOR PAPERMAKER'S FELT

BACKGROUND OF THE INVENTION

This invention relates to papermaker's wet press felts and more particularly to such a felt in which the opposite ends are joined by a pin seam.

The prior patent art contains numerous examples on pin-seam type felts for paper making machines, along with discussions of the advantages which can be gained by using pin-seam felt over a more conventional endless felt. These prior patents include the following U.S. Pat. Nos. and foreign patent documents:

Draper, Jr., 2,883,734 of Apr. 28, 1959
Kelleher, et al, 3,283,388 of Nov. 8, 1966
Codorniu, 3,815,645 of June 11, 1974
Cannon, 4,401,137 of Aug. 30, 1983
Lilja et al, 4,601,785 of July 22, 1986
Talonen et al, 4,698,250of Oct. 6, 1987
Johansson et al, 4,743,482 of May 10, 1988
Sakuma, 4,755,260 of July 5, 1988
Japanese patent 57-55358

Typically, the pin seam felt today is formed with a woven base fabric and carries one or more layers of needled batting material on one or both of the face surfaces of the base fabric. An advantage of the pin seam on such a felt is that the felt can be made as stiff as desired, and still get it threaded onto the paper making machine. If the same felt were woven endless, it would be very heavy, stiff, and difficult to install on the machine.

Difficulties are encountered in two general areas. The one of these difficulties resides in the necessity of threading the pin through the cross-machine fabric loops on the opposed ends of the felt. The ends of the felt must be brought together on the machine, and a flexible leader wire is threaded through the internested loops, a short section or length at a time. Then it is used to pull the pin through while Pulling the leader out of a gap between loops. This is repeated across the width of the machine, which may exceed 400 inches. The tedious process is often made all the more difficult because of cramped space and poor lighting.

A second difficulty resides in the necessity of cutting through the layer or layers of needled batting at the pin seam joint, since the joint was temporarily joined during felt manufacture and batt needling. Once the batting layer has been severed at the seam, it is very difficult to join it together again on the machine.

The above list of patent documents contains a number of examples of attempts to deal with this problem, including the Japanese publication, and the U.S. Pat. Nos. 4,764,417; 4,755,260; 4,743,482; 4,698,250; and 4,601,785. In several instances it has been suggested that the batting layer be cut on an oblique angle to the base fabric, or that it is cut along a line laterally offset from the seam, or both. In most cases, a flap of the batting layer is formed by the cut, and while the prior art talks in terms of securing lhe flap, such as by gluing, the fact is that most such batting flaps run free in use, and can cause undesirable marking on the paper.

SUMMARY OF THE INVENTION

This invention relates to a pin seam type of papermaker's felt, and more particularly to an improved seam in which a mechanical interlock is provided between the opposed cut ends of the batting at the pin seam. The mechanical interlock provides a surface by which the ends may be glued across the felt, and, at the same time, provides an improved locked-down butt end with less tendency to run free and flap, and thereby mark the paper, in use.

In the Preferred embodiment, the butt ends of the batting layer are formed by a cut which is substantially opposite the pin seam itself, although it could be offset therefrom, as shown in U.S. Pat. No. 4,601,785 above. One opposed butt end is formed with a Vee groove or notch running the full width, while the other end is formed with an interfitting and complementary Vee. The notch and the interfitting Vee are formed simultaneously, when the batting layer is severed and will therefore fit back together along the full width even though there could be some irregularities in making the cut.

After the pin has been inserted in the loops, glue may be applied to the butt end surfaces, and the ends of the batting layer may be interfitted and joined. The mechanical interlock provided assists in the maintenance of a smooth forming surface on the batting face, to minimize or eliminate marking.

It is therefore an important object of the invention to provide a self-locking or interlocking seam for the batting layer of a pin-seam felt.

Another object of the invention is he provision of an interlocking Vee notch across the width of the batting of a pin seam type of papermaker's felt, to eliminate flapping of the batting flap formed when the batting layer is cut at the pin seam.

These and other objects and advantages of the invention will be apparent from the following description, the accompanying drawings, and the appended claims.

BRIEF DESCRIPTION OF ACCOMPANYING DRAWINGS

DESCRIPTION OF PREFERRED EMBODIMENT

Figure 1:
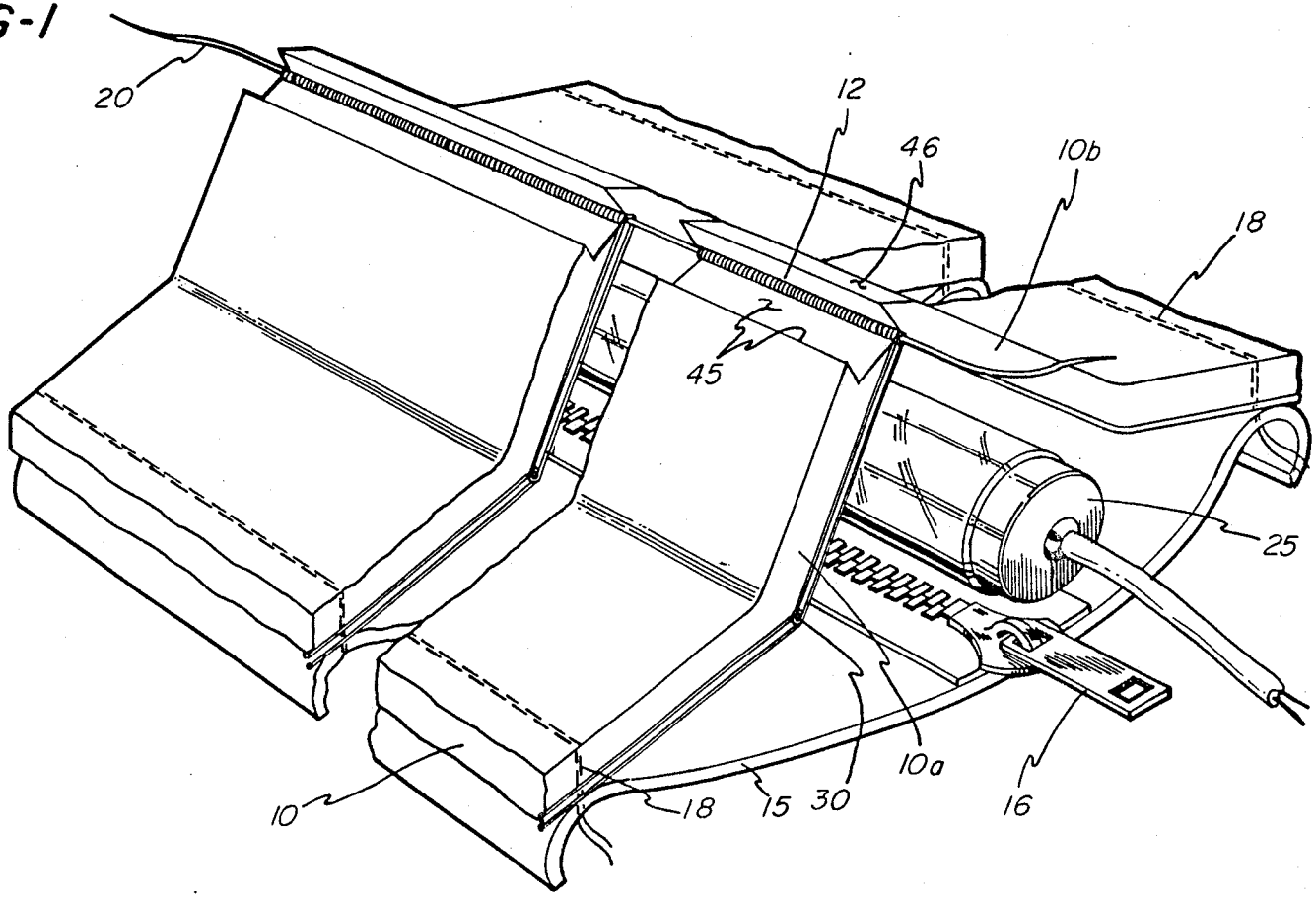
FIG. 1 is a perspective view, partially broken away, showing the assembly of the opposed ends of a pin seam formed in a needled felt of this invention.

Referring first to FIG. 1, the improved papermaker's felt of the invention is shown at 10 as including a left-hand butt end **10*a* and a right-hand butt end 10*b*. The felt 10 is shown in FIG. 1 in the process of being joined at the pin seam 12 on a paper machine. The butt ends are brought and retained in juxtaposition by an arrangement known as a "tent". The "tent" is formed by a transversely positioned canvass support 15 formed in two parts which are joined by a slide fastener 16**.

Figure 3:
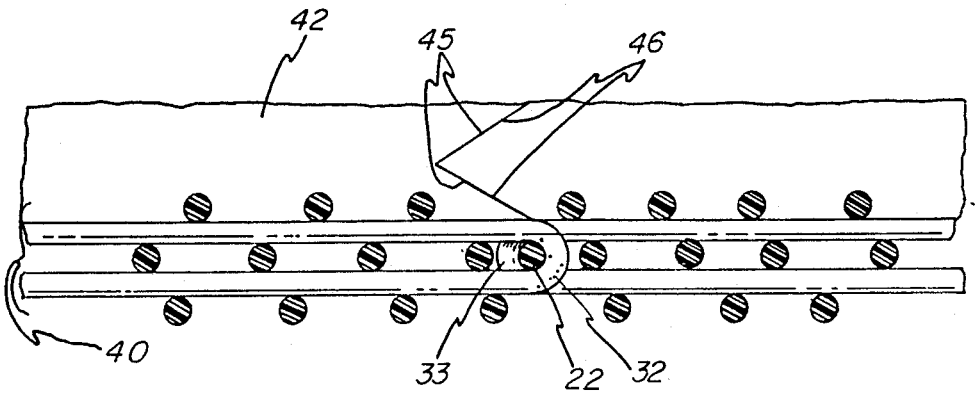
FIG. 3 is a view similar to FIG. 2 showing the interfitted and locked Vee ends and the pin in place, ready to run on the machine.

The ends of the canvas support are temporarily joined to each of the butt ends **10*a*, 10*b* of the felt, such as by a chain stitch 18, and when the ends are brought together on the machine, they are held by the joining together each of the canvas sections by the slide fastener. The butt ends are then elevated above the canvas 15 in the form of a tent, so that the loops forming the pin seam 12 may be brought together in interfitted alignment to accept the leader wire 20, to pull through the pin 22 (FIG. 3). A fluorescent tube 25 may be inserted into the tent space above the canvas 15** and underneath the seam 12, to illuminate the seam and aid in seeing the loops and t he leader wire 20.

The handling of the butt ends and the interfitting of the seam-forming loops may be materially assisted by providing a transverse hinge or region 30 of enhanced flexibility in one or both of the felt ends as more fully described in application of Nicholas et al, Ser. No. 305,320 filed Feb. 1, 1989. The alignment of the seam loops may also be materially enhanced by forming the respective end loops 32, 33 (FIG. 2) of contrasting colors, as more fully described in the copending application of Nicholas et al, Ser. No. 305,347 also filed Feb. 1, 1989.

Figure 2:
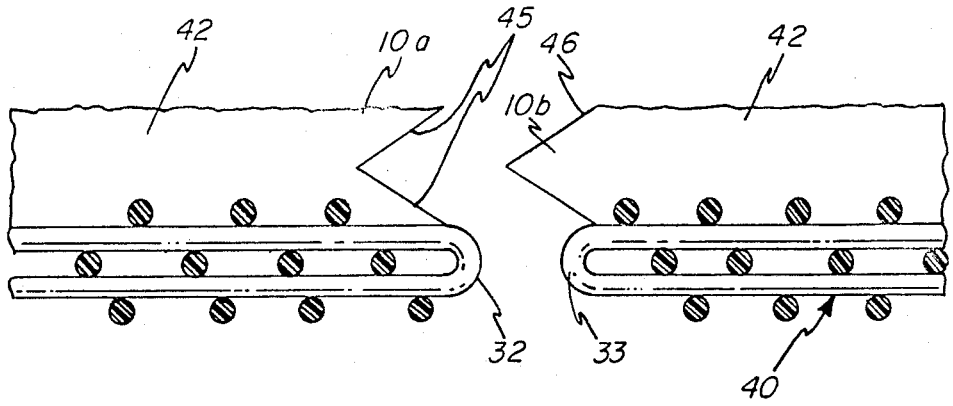
FIG. 2 is a diagrammatic side view of the opposed ends of the felt after the batting layer is cut and prior to assembly on the PaPer machine.

As shown in FIG. 2 and 3, the felt 10 has a woven base fabric structure 40 and a batting layer 42 applied as by needling into the base fabric, as is well known in the art. The batting layer 42 is severed in the region of the seam 12 defined by the loops 32, 33 to form an interlocking means in the form of a transverse Vee groove 45 and a mating protruding Vee 46 in the opposed free end of the batting. The interlocking portions are formed when the batting layer 42 is cut to expose the pin seam, and the previously connected ends are then brought together again as shown in FIG. 3, so that the parts will perfectly mate.

The batt seam may be directly above the pin seam, so as to form, in effect, a flapless seam as compared to the flap seam formed in U.S. Pat. No. 4,601,758 for example. Also, since the seam is self interlocking, it is not entirely dependant upon the integrity of the adhesive or glue to close the batting across the interface of the seam and prevent paper marking.

In the "tent" position as shown in FIG. 1, the batting seam defined by the parts 45 and 46, is open, and in effect, forms the apex of the tent. Once the pin 22 has been fully inserted, as described, the chain stitches 18 may be pulled to release the canvas 15, and bring the seam into closure, as shown in FIG. 3. Suitable glue may be applied to the respective Vee surfaces 45,46 and the parts brought together as shown in FIG. 3, and permitted to set up prior to starting up the machine.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a papermaker's felt having a base fabric with first and second opposed ends joined by a pin seam, and in which a relatively heavy batting is applied to one surface of said base fabric and extends to each of said base fabric ends forming batting free ends substantially coterminous with said base fabric ends, the improvement in said felt in which one free end of the batting is joined to the opposed free end thereof at the pin seam comprising:

means exclusively in one of said batting free ends forming a transverse Vee groove, and means exclusively in the opposed batting free end forming a transverse Vee proportioned to be received and interlocked in said groove when said base fabric ends are joined at said pin seam.

2. The felt of claim 1 further comprising glue means joining said batting ends along said interlocked Vee groove and Vee.

3. In a papermaker's felt having a base fabric with first and second opposed ends joined by a pin seam and in which a relatively heavy batting is applied to a surface of the base fabric and extends to each of said base fabric ends forming batting free ends substantially coterminous with said base fabric ends, the improvement in said felt in which one free end of the batting is joined to the opposed free end of the batting at the pin seam, comprising:

means in one of said free batting ends forming a groove which extends transversely of the width of said felt, and means in the opposed batting free end forming an outwardly projecting portion extending transversely of the width of said felt and proportioned to be received and interlocked with said groove when said base fabric ends are joined at said pin seam.

* * * * *